US006340313B1

(12) United States Patent
Hwang

(10) Patent No.: US 6,340,313 B1
(45) Date of Patent: Jan. 22, 2002

(54) TELEPHONE TRANSFER DOUBLE-SOCKET

(76) Inventor: Lih-Jiuan Hwang, P.O. Box No.6-57, Chung-Ho City, Taipei Hsien 235 (TW)

( * ) Notice: Subject to any disclaimer, the term of this patent is extended or adjusted under 35 U.S.C. 154(b) by 0 days.

(21) Appl. No.: 09/560,186

(22) Filed: Apr. 28, 2000

(51) Int. Cl.[7] ..... H01R 25/00
(52) U.S. Cl. ..... 439/638; 439/676
(58) Field of Search ..... 379/441, 71, 284, 379/90.01, 454, 422; 128/904; 439/638, 176, 676; D13/24

(56) References Cited

U.S. PATENT DOCUMENTS 4,626,633 A * 12/1986 Ruehl et al. ..... 379/27
D303,109 S * 8/1989 Matsuzaki et al. ..... D13/24
5,083,941 A * 1/1992 Rodgers et al. ..... 439/532
D327,470 S * 6/1992 Davis et al. ..... D13/147
5,143,868 A * 9/1992 Caveney et al. ..... 439/535
5,178,554 A * 1/1993 Siemom et al. ..... 439/188
5,601,451 A * 2/1997 Driones et al. ..... 439/490
5,666,408 A * 9/1997 Lao ..... 379/442
5,697,815 A * 12/1997 Drewnicki ..... 439/638
6,012,951 A * 1/2000 Krawes et al. ..... 439/620
6,116,958 A * 9/2000 Reichle ..... 439/640

* cited by examiner

*Primary Examiner*—Khiem Nguyen
(74) *Attorney, Agent, or Firm*—Troxell Law Office PLLC

(57) ABSTRACT

The design of a telephone transfer double-socket, which comprises mainly of such assembling members as a male plug, a socket body, several guide-joining terminals, and a stopper plate; the interior of the socket body is integrally formed to have two insertion holes which are in two different shapes and are arranged side by side with each other; two connecting foot are fixed at the rear end section of the several guide-joining terminals to enable these guide-joining terminals to be implanted in the male plug, and also enable it to cover at one lateral side of the male plug by means of the stopper plate to exert a pressure for positioning; then cause the bottom end seat of the male plug to be set at the opening of the socket body and, at the same time, cause the connecting foot of the several guide-joining foot to extend and insert into the two insertion holes in the interior of the socket body; in so doing, by means of the functioning of the guide-joining terminals, the assembly members related herein can the simplified to enable the assembling process to be easily conducted, to the ultimate effect of saving the cost of production.

1 Claim, 5 Drawing Sheets

TELEPHONE TRANSFER DOUBLE-SOCKET

BACKGROUND OF THE INVENTION (a) Field of the Invention

The design is related to a telephone transfer double-socket, especially denoting a monotype of telephone socket which may, in addition to providing a similar type of plug for connecting, also provide a double-socket structure for lugging another type of plug. The structure comprises of a male plug which is set in front of the body of the socket to enable the male plug to connect directly with the two socket holes at the rear end of the socket body by means of several guide-joining terminals. Since the design is not only easy to assemble, but is also simple in its component members, its production cost can, therefore, be reduced.

(b) Description of the Prior Art

As is commonly known, a conventional telephone transfer socket usually comprises of such basic components members as male plug, a shell body, a socket body, a circuit board, and several connecting terminals, in which the male plug is usually set at one lateral side of the shell body, with several guide-joining terminals implanted into the male plug, at the end of which a connecting wire pierced through the reverse side of the shell body to connect with the circuit board; after allowing the combination of the connecting terminals in the interior of the socket body with the circuit board, the commination body will jointly cover at the reverse side of the shell body to form a transfer socket. However, the structuring of the above-mentioned telephone transfer socket needs to have the availability of a plurality of spare and component members, and to pass through an assembling process before completion. When the male plug and the socket body differed in shape, the connecting wire will have to be welded in an intersecting manner onto the corresponding position of the circuit board. Such a design indicated a more difficult and complicated assembling process which will relatively increase the production cost. And its telephone transfer socket becomes large in size and occupies much space due to the limitation of their pattern and space. Therefore, it seems not to be very ideal no matter speaking in terms of conveyance, packaging of finished-products or utilization.

SUMMARY OF THE INVENTION

The main objective of the present invention is to provide the design of a telephone transfer double-socket, which comprises of a male plug, a socket body, several guide-joining terminals and a stopper plate; the interior of the socket body is integrally formed, with insertion holes made in two different shapes and piercing holes lining side by side; several guide-joining terminals are having two connecting foot at their rear end to allow the several guide-join in terminals to be implanted within the male plug, positioning by means of covering the stopper plate at one lateral side of the male plug to exert pressure; and further cover the bottom end seat of the male plug at the opening of the socket body, and at the same time allow the connecting foot of the several guide-joining terminals to insert into the two insertion holes in the interior of the socket body; in so doing, by means of the guide-joining terminals, the spare and component members for assembling can be simplified to enable assembling to be processed easily, so as to save the cost of production.

The secondary objective of the present invention is to provide the design of a telephone transfer double-socket to enable the extreme end of the guide-joining terminals to extend outward and have a first connecting foot and a second connecting foot; the joining place of the two connecting foot with the terminal body is set in a twisting state in a horizontal plane direction, while the first connecting foot resembled a left or right sideward deviation, and the two ends of the two connecting foot formed a concaved arc shape which, when the two connecting foot are inter-connected with the other telephone plug, will enable it to provide an excellent springing connection to further enable the transmission of signal to be conducted in an extremely stable manner without producing any noise.

DETAILED DESCRIPTION OF THE PREFERRED EMBODIMENTS

Figure 1:
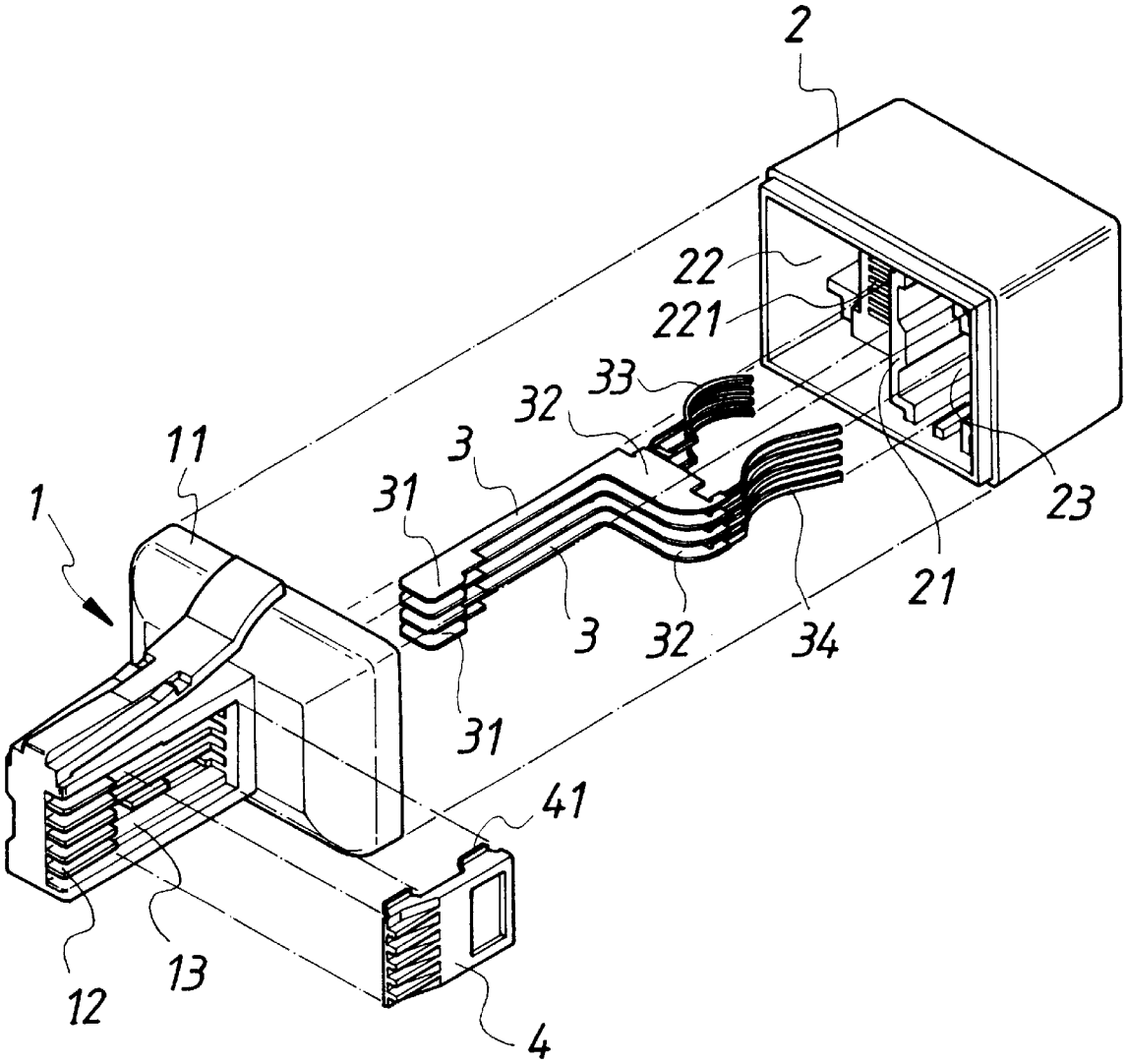
FIG. 1 is a segmentation solid drawing of the present invention.
Figure 2:
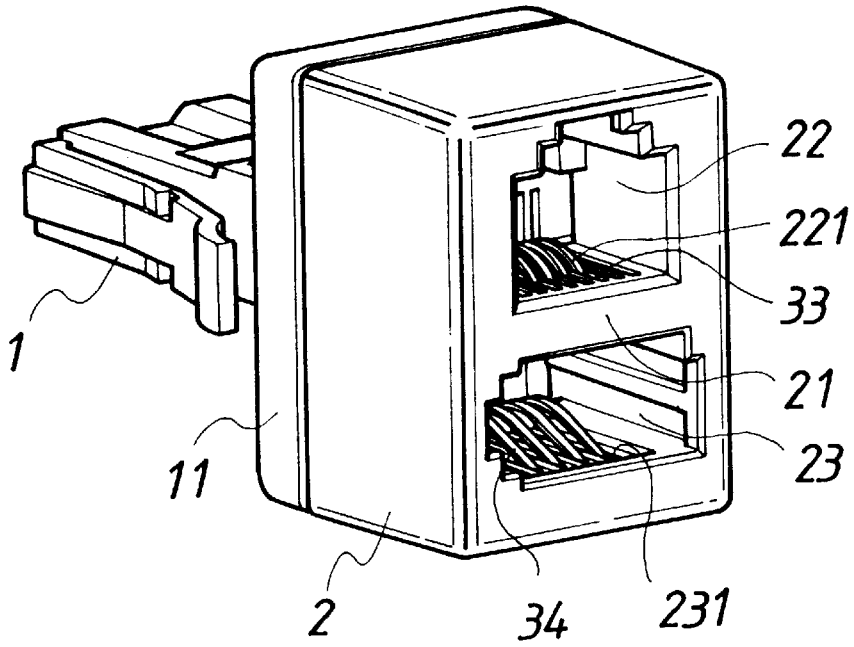
FIG. 2 is an erection steregraph drawing of the present invention.
Figure 3:
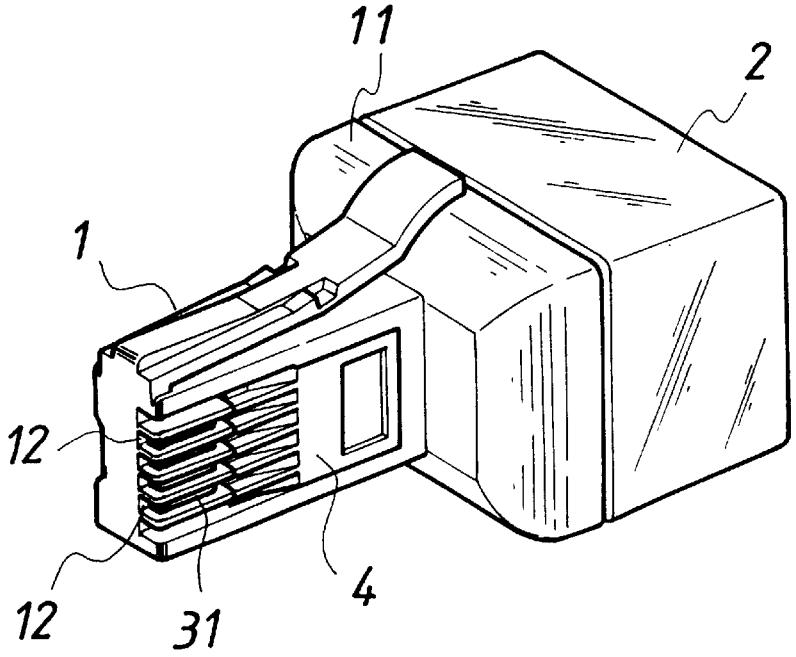
FIG. 3 is another visual angled stereograph drawing of the present invention.
Figure 4:
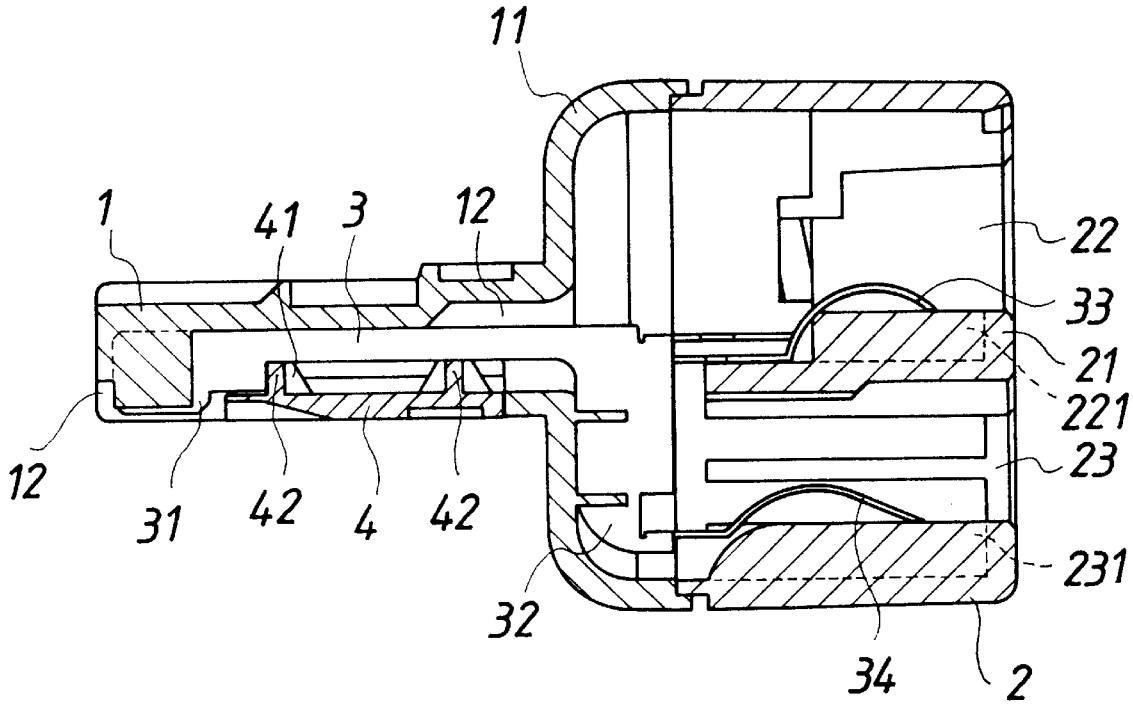
FIG. 4 is an assembling sectional drawing of the present invention.
Figure 5:
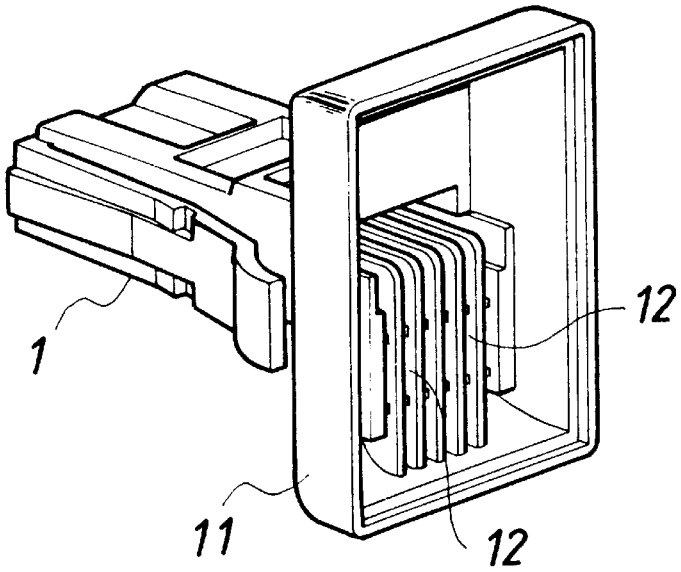
FIG. 5 is another visual angled sterograph drawing of the present invention.
Figure 6:
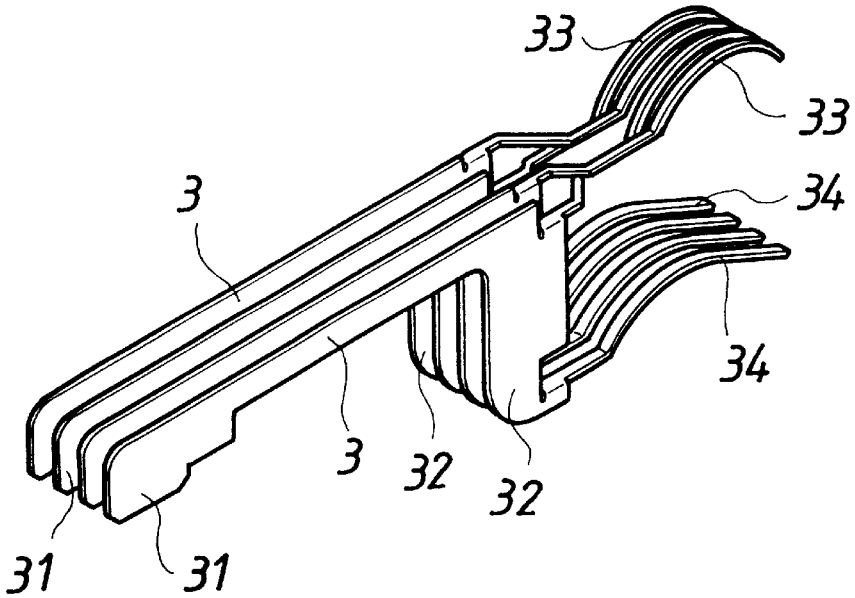
FIG. 6 is a sterograph indicative drawing of the connecting terminal of the present invention.
Figure 7:
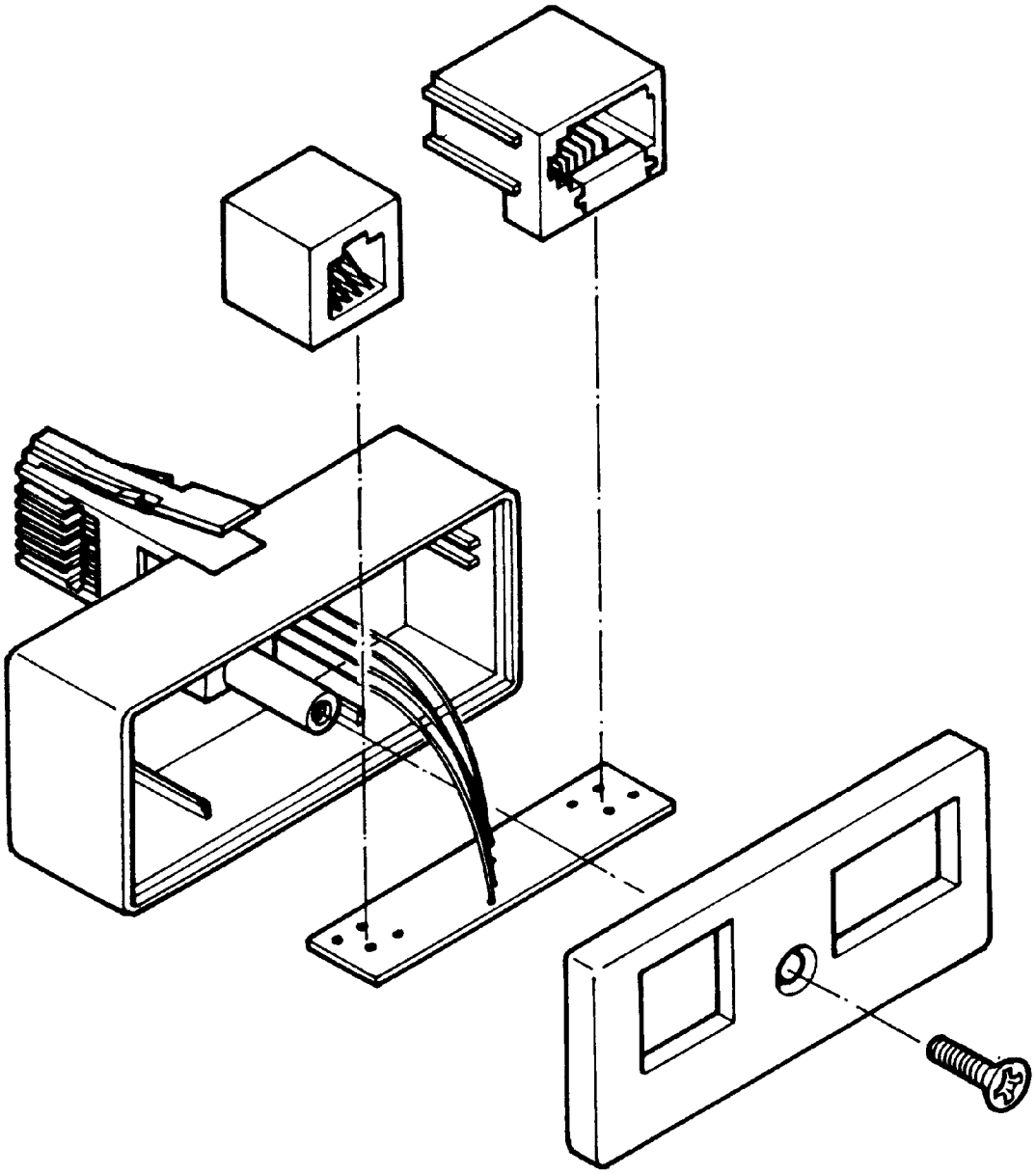
FIG. 7 PRIOR ART
FIG. 7 is an outward sterography drawing of a convention a telephone transfer socket.

As indicated in FIGS. 1 to 3, the present invention is related to the design of a Telephone Transfer Double Socket, which comprises of a male plug 1, a socket body 2, several guide-joining terminal 3, a stopper plate 4, etc., in which:

For male plug 1, please refer to FIGS. 1 to 5, which is made in the type of a British telephone plug, and its extreme end is integrally made to have a bottom end seat 11, while at the rear end of guiding groove 12 at one of its lateral side a concaved section 13 is formed, and guiding groove 12 can be connected to the interior of bottom end seat 11;

Socket body 2 is an opening shape of transparent shell body, and its interior is partitioned by rib 21 to form an American type of telephone insertion hole 22 and a British type of telephone insertion hole 23 to allow the two insertion holes to line up side by side, having guiding grooves 221. 231 which are equally partitioned with guiding groove 12 at one lateral wall of each insertion holes 22. 23;

Connecting terminal 3, as indicated in FIGS. 1 and 3, its body is a long strip body, having its front end protruded to form a guiding terminal head 31 in a direction towards one of its lateral side, with a vertical piece 32 falling at its rear end to enable the upper and lower end of vertical piece 32 to extend outward to form a first connecting foot 33 and the second connecting foot 34. However, both the two connecting foot are set in a twisting state with vertical piece 32 and formed in a horizontal direction, and the first connecting foot 33 is set in a left or right sideward deviation at a place which it selected, and the end of the two connecting foot formed a concaved arc shape;

Stopper plate 4, which is set corresponding with concaved section 13 of the male plug, is having a hooking piece 41 fixed upside down on each of the front and rear end lateral wall at the two lateral sides to correspond and buckle into concaved section 13 to form stopping and positioning; furthermore, a resistance piece 42 is set on each of the surface of the front and rear end bottom end of stopper plate 4;

By utilization of the above-mentioned assembling members, please refer to the indication per FIG. 4, and enable the guide-joining terminal head 31 of each guide-joining terminal 3 to insert into each of guiding groove 12 along the bottom end of male plug 1, to further enable both the first connecting foot 33 and the second connecting foot 34 to be exposed at the outer lateral side of bottom terminal seat 11, and then enable bottom terminal seat 11 to cover at the opening of socket body 2; at the same time enable the first connecting foot 33 to insert into American type of telephone insertion hole 22, while the second connecting foot 34 is inserted into British type of telephone insertion hole 23, and connecting foot 33 and 34 are stuck within guide-joining groove 221. 231 respectively which they are corresponding to; then enable stopper plate 4 to cover onto concaved section 13 of male plug 1 to enable resistance piece 42 to exert a pressure against guide-joining terminal 3 to enable it to be positioned; in so doing, by means of the guide joining directed by guide-joining terminal 3, the spare and component members for assembling can be simplified to make the assembling process to be conducted more easily, so as to save the production cost.

In addition, as the connecting place of the two connecting foot 33. 34 at the extreme end of guide-joining terminal 3 and the terminal body is set in a bending state to form a horizontal plane direction, and the bending arc shape of its end terminal section enabled the providing of an excellent springing guide joining when the two connecting foot 33. 34 are inter-inserted with another telephone plug to enable signal transmission to be conducted steadily without producing any noise; and in the process of assembling, just implant connecting foot 33 of guide-joining terminal 3 in an intersecting side by side arrangement manner into guiding groove 12 of male plug 1. Therefore, when male plug 1 is covering onto socket body 2, its two connecting foot 33. 34 can be inserted into guiding grooves 221. 231 which each of them is corresponding to according to the fixed position to effectively raise its production capacity and reduce the occurrence of defective proportion.

What is claimed is:

1. A telephone transfer double socket comprising:

a) a socket body bounding an interior space and having a wall defining two insertion holes in communication with the interior space, the two insertion holes having different configurations from each other for accepting two different types of telephone plugs, the socket body having a partition extending from the wall into the interior space between the two insertion holes;

b) a male plug having a terminal seat attached to the socket body, the male plug configured to be inserted into a female telephone plug having the same configuration as one of the two insertion holes, the male plug having a distal end with a plurality of separated guiding grooves, and a section with a recess;

c) a plurality of spaced apart connecting terminals having connecting feet extending into the two insertion holes, elongated, planar bodies having planar connecting portions from which the connecting feet extend, the planar connecting portions contacting the terminal seat, and terminal heads formed on the elongated bodies, the terminal heads being located in the guiding grooves in the male plug; and, d) a stopper plate mounted in the recess on the male plug, the stopper plate having a resistance piece in contact with the terminal heads of the connecting terminals so as to retain the connecting terminals in desired positions.

* * * * *